United States Patent [19]

Bibber

[11] Patent Number: 4,711,667

[45] Date of Patent: Dec. 8, 1987

[54] CORROSION RESISTANT ALUMINUM COATING

[75] Inventor: John W. Bibber, Batavia, Ill.

[73] Assignee: Sanchem, Inc., Chicago, Ill.

[21] Appl. No.: 908,827

[22] Filed: Sep. 18, 1986

Related U.S. Application Data

[63] Continuation-in-part of Ser. No. 902,150, Aug. 29, 1986, abandoned.

[51] Int. Cl.[4] ..... C23F 11/18

[52] U.S. Cl. ..... 106/14.21; 148/6.27

[58] Field of Search ..... 148/6.27; 106/14.21

[56] References Cited

U.S. PATENT DOCUMENTS

| | | | |
|---|---|---|---|
| 1,607,676 | 11/1926 | Jirota . | |
| 1,677,667 | 7/1928 | Zimmerman . | |
| 1,710,743 | 4/1929 | Page . | |
| 1,811,298 | 6/1931 | Boulanger . | |
| 1,965,269 | 7/1934 | Tosterud | 148/6 |
| 2,276,353 | 3/1942 | Thompson | 148/6 |
| 2,465,443 | 3/1949 | Gide | 148/6.21 |
| 2,512,493 | 6/1950 | Gide | 148/6.21 |
| 2,681,873 | 2/1954 | Deniston | 148/6.21 |
| 2,785,091 | 3/1957 | Rex | 117/129 |
| 2,820,731 | 1/1958 | Heinzelman et al. | 148/6.15 |
| 2,883,311 | 4/1959 | Halpert | 134/3 |
| 2,981,647 | 4/1961 | Schwartz | 148/6.14 |
| 3,516,877 | 6/1970 | Papafingos et al. | 148/6.27 |
| 3,573,997 | 4/1971 | Plaxton | 148/6.16 |
| 3,706,604 | 12/1972 | Paxton | 148/6.16 |
| 3,749,596 | 7/1973 | Nara | 117/127 |
| 3,752,708 | 8/1973 | Newell et al. | 148/6.2 |
| 3,871,881 | 3/1975 | Mikelsons | 96/1.5 |
| 4,145,234 | 3/1979 | Meissner | 148/6.27 |
| 4,427,458 | 1/1984 | Hasegawa et al. | 148/6.2 |

OTHER PUBLICATIONS

Grant, Hackh's Chem. Dict., 4th Ed., 1969, p. 114.

Berdzenishvili et al.-72-Electrochemistry 156854s, vol. 102, 1985.

Mikhailovskii et al.-Chemical Abstracts 182163u, vol. 100, 1984.

Plenkova et al., 72 Electrochemistry 93394c, vol. 100, 1984.

El-Sobki et al., 72 Electrochemistry 112211h, vol. 96, 1982.

Bruno et al.-Chemical Abstracts 97914z, vol. 66, 1967.

Kravchenko et al., 20 Nonferrous Metals and Alloys, 6738.

Asada-Chemical Abstracts, vol. 64, p. 17044.

Reschke et al.-Chemical Abstracts, vol. 36, p. 5760.

Collari, 9 Metallurgy and Metallography, p. 5814.

Collari et al., Chemical Abstracts, p. 4760.

Seidell et al., American Chemical Society, 1964.

F. Albert Cotton et al., 72 Advanced Inorganic Chemistry, 853, 25-D-6.

*Primary Examiner*—Robert A. Wax

*Attorney, Agent, or Firm*—Laff, Whitesel, Conte & Saret

[57] ABSTRACT

An aluminum conversion coating by coating composition for coating aluminum or an aluminum alloy. The composition has as an essential ingredient an alkaline metal permanganate and a pH of 7 to less than 12.5. The composition containing a buffer, such as alkaline metal tetraborate, is effective for protecting the aluminum and aluminum alloys for more than 168 hours in salt fog at 95° F. according to standard ASTM method B-117. The process, of coating the aluminum or aluminum alloy is generally carried out by cleaning the aluminum or aluminum alloy with sodium hydroxide, hydrofluoric acid or borax and then coating with the permanganate composition.

36 Claims, No Drawings

CORROSION RESISTANT ALUMINUM COATING

This is a continuation-in-part application of my patent application Ser. No. 06/902,150 filed Aug. 29, 1986, now abandoned.

The present invention relates to a corrosion resistant coating for aluminum and aluminum alloys and the process for coating aluminum and aluminum alloys with a protective corrosion resistant coating.

BACKGROUND OF THE INVENTION

Generally, aluminum or aluminum alloys are protected by forming thereon an intermediate corrosion resistant conversion coating and then painting over the corrosion resistant coating. Therefore, the corrosion resistant coating must be intimately bonded to the aluminum surface and also provide the required adhesion with the desired final aluminum coating—i.e., paint.

An accepted process for protecting aluminum and aluminum alloys with a corrosion resistant intermediate coating is to coat the surface of the aluminum and aluminum alloys with a protective conversion coating of an acid based hexavalent chromium composition.

Hexavalent chromium has been widely accepted as an intermediate corrosion resistant conversion coating because it protects the aluminum and aluminum alloy surfaces for extended periods of time. The hexavalent chromium provides a corrosion resistant coating which can withstand a salt fog bath for more than 168 hours. The coated aluminum or aluminum alloy is placed in a salt fog at 95° F. according to ASTM method B-117 for at least 168 hours and then removed. This requirement is necessary for many applications. Further, the hexavalent chromium composition provides an intermediate coating which is receptive to the application and retention of other coatings, such as paints, to the aluminum or aluminum alloy surfaces.

The excellent features of the hexavalent chromium composition have made these compositions used extensively for the corrosion resistant protection of aluminum and aluminum alloys and as an intermediate corrosion resistant coating.

However, the hexavalent chromium compositions have a serious side effect. Chromium is highly toxic and the spent chromium compositions provide an ecological problem. Many people in the industry are attempting to eliminate this ecologically damaging waste problem and it is very costly.

Other corrosion resistant compositions have been suggested but they have not been as successful as the hexavalent chromium compositions.

In 1940 Collari reported for the first time on the inhibiting action of potassium permanganate against attack by sodium hydroxide on aluminum. (*Chemical Abstracts* 5814–6, Volume 34, 1940) In 1941 Lilli Reschke and Heinrick Neunzig (*Chemical Abstracts,* Vol. 36, 1942, 5760–5–7) reported the first study on the inhibiting action of potassium permanganate against the attack by sodium hydroxide on aluminum. Finally, in 1947 (*Chemical Abstracts* 4759 e.g., Vol. 41, 1947) Collari and Fongi also compared the inhibiting action of potassium permanganate to sodium chromate in inhibiting attack by sodium hydroxide on aluminum at various temperatures.

Various compositions of sodium chromate and sodium hydroxide were utilized, and sheets of aluminum were immersed in these solutions. The solutions all had a pH of 12.5 or greater than 12.5.

It was appreciated, after these articles, that the most effective corrosion resistant coatings were those which are acid based. The basic compositions of hexavalent chromium were not effective for prolonged corrosion protection of aluminum surfaces. Neither the basic chromium nor the basic permanganate which have a pH of greater than 12.5, would be appropriate for the corrosion resistant coating of aluminum wherein the aluminum requires a corrosion protection in a salt fog of greater than 168 hours. Further, the industry decided that basic compositions were inadequate for their purposes because highly basic solutions attacked aluminum surfaces. The industry has concentrated their efforts on acid based conversion coating compositions.

In some applications, the acid chromate composition was combined with potassium permanganate to form a black coating. The pH of the solution stayed in the preferred range of 2–3, U.S. Pat. No. 4,145,234.

Also, it has been suggested that the use of the oxidizing agents, sodium or potassium chromate and potassium permanganate, may be added to an electrolyte solution to inhibit the corrosion of aluminum electrodes.

In the immersion coating of aluminum with a chromium coating the thickness of the chromium coating is usually varied by the amount of time the aluminum or aluminum alloy was in contact with the corrosion resistant composition.

SUMMARY OF THE INVENTION

Our invention eliminates some of the problems of the hexavalent chromium compositions by providing a corrosion resistant coating composition which, if desired, contains no chromium or other similar toxic materials. Also, for those applications which require it, we provide a corrosion resistant coating for aluminum or aluminum alloy surfaces which can withstand a salt fog at 95° F. according to ASTM method B-117 for at least 168 hours, and which when desired, will provide an excellent intermediate coating.

Also, we eliminate the need for special handling, which is sometimes required by acid solutions, by providing a basic coating composition which can, if desired, contain no chromium.

Accordingly, this invention is directed to providing a protective coating for aluminum and aluminum alloys, which has as an essential ingredient, an alkali metal permanganate in a solution having a pH in the range of 7 to less than 12.5.

Another aspect of the invention is to provide a protective corrosion resistant coating for aluminum and aluminum alloys which comprises as an essential ingredient an alkali metal permanganate and a buffer compound selected from alkali metal tetraborate, alkaline metal metaborate, benzoic acid, alkali metal benzoate, alkaline metal carbonate and a mixture of the alkali metal tetra- and metaborates.

It is still another object of the present invention to provide a method for protecting aluminum and aluminum alloys with a protective corrosion resistant coating comprising coating the aluminum or aluminum alloy with a corrosion resistant coating composition containing an essential ingredient, an alkali metal permanganate, and said composition having a pH in the range of 7 to less than 12.5.

Still another aspect of the present invention is to clean the aluminum or aluminum alloy surfaces with an appropriate cleaning solution which will not interfere with the bonding of the corrosion resistant coating onto the surfaces of the aluminum or aluminum alloys. Preferred cleaning solutions are the alkali nitrate solutions, i.e., alkali sodium nitrate solution; alkaline metal hydroxides - i.e., sodium hydroxide; hydrofluoric acid; and borax.

The alkaline metal permanganate composition may be applied in any acceptable manner (i.e., immersion, spraying, misting or spreading by an appropriate applicator).

The pH of the composition is between 7 and less than 12.5. The preferred pH range is about 9 to 10.

The aluminum or aluminum alloy surface is normally immersed in an aqueous alkali metal permanganate solution which is at a temperature between room temperature and the boiling point of the composition. The preferred temperature is between 60° and 175° F., with the most preferred between 100° and 175° F. However, as the temperature is raised, less immersion time is necessary to form the corrosion resistant coating on the aluminum or aluminum alloy surfaces.

The alkali metal is selected from potassium, sodium or lithium. The preferred alkali metal permanganate is potassium or sodium permanganate. The concentration of the permanganate, to provide 168 hours of salt fog protection for the aluminum or aluminum alloys, is of a sufficient amount to provide at least 700 ppm of Manganese in the coating solution with the practical maximum being the saturation point of the permanganate. When potassium permanganate is used, the concentration is about 0.2% by weight. At room temperature, a saturated $KMnO_4$ solution is 6.3% by weight; 32° F. is 2.8% by weight and at 212° F. is 28% by weight. The sodium permanganate is infinitely soluble and, therefore, has no practical upper limit.

The buffers which we use in our composition are alkali metal tetra- and metaborate, benzoic acid, alkaline metal benzoate, and the alkali metal carbonates. The benzoic acid is used only in quantities which will not lower the pH to less than 7. If the quantity of benzoic acid is too great, NaOH can be added to neutralize the acid or change it to sodium benzoate. In any event, the pH of composition is not to fall below 7. The tetraborate is preferably a hydrated tetraborate, and the hydrated sodium tetraborate is commonly referred to as borax i.e., $Na_2B_4O_7 \cdot 10\ H_2O$. In our examples, we use borax-$5 \cdot H_2O$; i.e., $Na_2B_4O_7 \cdot 5H_2O$. It is our understanding that the non-hydrated borates are equivalent to the hydrated borates, and that the 10 hydrated borax is equivalent to the 5-hydrated borax with the exception of the 10-hydrated borax containing more water of hydration. The preferred buffers are borax–$5 \cdot H_2O$, alkaline metal benzoate and sodium carbonate. The preferred concentration of alkali metal benzoate is 0.05% to 44.0% by weight. The preferred concentration of $Na_2CO_3$ is 0.05% to 31.5% by weight.

The preferred immersion time, for preparing a corrosion inhibiting coating on aluminum or aluminum alloy surfaces, is approximately one minute at 155° F. and approximately one hour at room temperataure. A longer immersion time, than the predetermined optimum time does not increase the coating thickness to any appreciable amount and, therefore, would not be economically worthwhile.

Other compounds may be added, if desired, providing the compounds do not interfere with the desired corrosion resistant protection of the aluminum or aluminum alloy surfaces.

The cleaning compounds, for the aluminum or aluminum alloy surfaces, are sodium hydroxide, alkaline solutions of sodium nitrate, hydrofluoric acid, sodium bicarbonate, sodium carbonate, and borax. The preferred are sodium hydroxide or hydrofluoric acid.

It is also recommended that neither the cleaning composition nor the corrosion resistant alkali metal permanganate composition contain a silicate, phosphate, sulphate, a fatty acid, or any compound which would interfere with adhesion or formation of a protective coating on the aluminum or aluminum alloy surface.

The following examples 1 to 4 illustrate for comparative purposes the use of a composition of potassium permanganate and sodium hydroxide for coating aluminum. These examples show that this composition does not provide the corrosion resistance for aluminum that is provided by our composition and process. In all of the following examples, all percentages are percentages by weight, unless otherwise indicated. In the following examples 1–13, an aluminum alloy panel is used which is made from the aluminum alloy (Alloy No. 3003H14) purchased from Q-Panel Company of Cleveland, Ohio. It is understood that this alloy has more than 95% by weight of aluminum and has on average a composition of by weight 96.75% Al, 0.6% Si, 0.7% Fe, 0.5% Cu, 1.2% Mn, 0.1% Zn and 0.15% maximum other elements as impurities.

EXAMPLE 1

(a) The aluminum alloy panel was degreased with mineral spirits and cleaned in a 0.1% sodium hydroxide solution for one minute at room temperature. The panel was rinsed and then immersed in a room temperature solution of 1% potassium permanganate and 0.1% sodium hydroxide with the remainder being water. The aluminum panel was exposed for approximately 1 minute.

(b-d) The above procedure was repeated with solutions containing 0.5%, 1% and 2% sodium hydroxide.

In all of the above cases the panel was removed from the permanganate sodium hydroxide solution, rinsed with water, and then wiped. With the exception of the 1.0% and 2.0% sodium hydroxide solution, which left no film, a very thin tan coating remained. When placed in a salt fog at 95° F. according to ASTM method B-117, pitting began after a few hours of exposure.

EXAMPLE 2

The procedure of Example 1 was repeated with each of the solutions except the exposure time for each of the solutions was increased to one hour. A much thicker coating appeared on all of the aluminum panels. The coating did not completely wipe off. The panels were dried and placed in a salt fog at 95° according to standard ASTM method B-117. All the panels showed noticeable pitting after a few hours. The pitting was more extensive with the 2.0% solution than the 0.1% NaOH solution. Also, the panels subjected to the 1% and 2% NaOH solutions showed a substantial loss of aluminum from the panel.

EXAMPLE 3

The procedure of Example 1 was followed for each of the solutions except the temperature of each of the coating solutions were raised to and maintained at 155° F.

When the panels were removed after 1 minute of immersion, it was noted that there was considerable loss of aluminum metal especially with the 0.5%, 1% and 2% NaOH solutions and considerable pitting after being subjected to a few hours of salt fog at 95° F., ASTM method B-117. The loss of aluminum was greater as the concentration of the NaOH increased.

EXAMPLE 4

The procedure of Example 3 was followed for each of the solutions with each coating solution maintained at a temperature of 155° F. and the immersion time increased to 15 minutes.

When the panels were removed from the 0.5% and 1% NaOH solutions, they were rinsed, dried and subjected to an eight hour salt fog at 95° F. of ASTM method B-117. Considerable pitting was noted on each panel and more aluminum metal was lost than in Example 3. At 2% of NaOH, the aluminum metal strip used was entirely dissolved.

The loss of aluminum metal and the relatively short protection time is a serious drawback to the use of a sodium hydroxide potassium permanganate composition. It is further noted, that the pH of all of the above solutions was 12.5 or greater.

The following examples illustrate the compositions and process of our invention. The examples are for illustrative purposes and are not intended to limit the invention to the specifics of each example. Aluminum alloy of the same composition used in Examples 1–4 is used.

EXAMPLE 5

An aluminum panel was degreased with mineral spirits and then cleaned in a 0.5% sodium hydroxide solution for one minute at room temperature. After rinsing with water, the panel was immersed for one minute at 155° F. in a solution consisting of:

1.0% Borax-$5H_2O$ ($Na_2B_4O_7 \cdot 5H_2O$)
0.2% Potassium Permanganate ($KMnO_4$)
0.1% Sodium Nitrate ($NaNO_3$)
98.7% Water The panel was rinsed off with water, dried and placed in a salt fog at 95° F. for 408 hours according to standard ASTM method B-117. The panel showed no noticeable pitting in the treated area.

EXAMPLE 6

An aluminum panel was degreased with mineral spirits and then cleaned in a 1.0% hydrofluoric acid solution for one minute at room temperature. After rinsing with water, the panel was immersed for one minute at 155° F. in a solution consisting of:

0.05% Borax-$5H_2O$
3.0% Potassium Permanganate
96.95% Water

The panel was rinsed off with water, dried and placed in a salt fog at 95° F. for 168 hours according to standard ASTM method B-117. The panel showed no noticeable pitting in the treated area.

EXAMPLE 7

An aluminum panel was degreased with mineral spirits and then cleaned in a 0.5% sodium hydroxide solution for one minute at room temperature. After rinsing with water, the panel was immersed for one minute at 155° F. in a solution consisting of:

9.0% Borax-$5H_2O$
4.0% Potassium Permanganate
87.0% Water

The panel was rinsed off with water, dried and placed in a salt fog at 95° F. for 192 hours according to standard ASTM method B-117. The panel showed no noticeable pitting in the treated area.

EXAMPLE 8

An aluminum panel was degreased with mineral spirits and then cleaned in a 1.0% hydrofluoric acid solution for one minute at room temperature. After rinsing with water, the panel was immersed for one minute at 155° F. in a solution consisting of:

1.0% Borax-$5H_2O$
1.0% Potassium Permanganate
98.0% Water

Prior to the panel being immersed, the PH of the solution was adjusted to 11.0 by the addition of the sodium hydroxide. The panel was rinsed off with water, dried and placed in a salt fog at 95° F. for 168 hours according to standard ASTM method B-117. The panel showed minor pitting in the treated area. The adjustment of the pH to 11.0 converted the borax to metaborate ($NaBO_2$-$4H_2O$).

EXAMPLE 9

An aluminum panel was degreased with mineral spirits and then cleaned in a 1.0% hydrofluoric acid solution for one minute at room temperature. After rinsing with water the panel was immersed for one minute at 155° F. in a solution of:

1.0% Potassium Permanganate
1.0% Borax-$5H_2O$
98% Water

Prior to the panel being immersed, the pH of this solution was adjusted to 12.5 by the addition of sodium hydroxide. The panel was rinsed off with water, dried, and placed in a salt fog at 95° F. for 96 hours according to standard ASTM method B-117. The panel showed minor pitting in the treated area. The adjustment to a pH of 12.5 converted the borax to metaborate ($NaBO_2$-$4H_2O$)

EXAMPLE 10

An aluminum panel was degreased with mineral spirits and then cleaned in a 0.5% sodium hydroxide solution for one minute at room temperature. After rinsing with water, the panel was immersed for one minute at 155° in a solution consisting of:

1.0% Potassium Permanganate
1.0% Sodium Benzoate ($C_7H_5O_2Na$)
98.0% Water

Prior to treatment, the solution was adjusted to a pH of 9.2 by the addition of sodium hydroxide. After treatment, the panel was rinsed off with water, dried and placed in a salt fog at 95° F. for 192 hours according to standard ASTM method B-117. The panel showed no observable pits in the treated area.

EXAMPLE 11

An aluminum panel was degreased with mineral spirits and then cleaned in a 0.5% sodium hydroxide solution for one minute at room temperature. After rinsing with water, the panel was immersed for one minute at 155° F. in a solution consisting of:

1.0% Sodium Carbonate ($Na_2CO_3$)
1.0% Potassium Permanganate
98.0% Water

After treatment, the panel was rinsed with water, dried and placed in a salt fog at 95° F. for 168 hours according to standard ASTM method B-117. The panel showed no observable pits in the treated area.

EXAMPLE 12

An aluminum panel was degreased with mineral spirits and then cleaned in a 1.0% hydrofluoric acid solution for one minute. After rinsing with water, the panel was immersed for one minute at 155° F. in a solution consisting of:

1.0% Potassium Permanganate
99.0% Water

The pH of the solution was 8.5. After treatment, the panel was rinsed with water, dried and placed in a salt fog at 95° F. for 5.0 hours according to ASTM method B-117. The entire panel was pitted, but much less so in the treated area.

EXAMPLE 13

An aluminum panel was degreased with mineral spirits and then cleaned in a 0.5% sodium hydroxide solution for one minute at room temperature. After rinsing with water, the panel was immersed for one minute at 155° F. in a solution consisting of:

3.0% Potassium Permanganate
1.0% Borax-$5H_2O$
96.0% Water

After treatment, the panel was rinsed with water, dried and placed in a salt fog at 95° F. for 168 hours according to standard ASTM method B-117. The panel showed no observable pits in the treated area.

In the following example, there is used an aluminum alloy panel received from Lockheed Aircraft Corp., Burbank, Calif. The panel was made from aluminum alloy No. 2024-T3 and was cladded with aluminum.

EXAMPLE 14

The aluminum alloy panel was degreased with mineral spirits, washed for one minute in a 0.5% sodium hydroxide solution, and then treated for one minute at 155° F. in a solution of:

3.0% Potassium Permanganate ($KMnO_4$)
1.0% Borax ($Na_2B_4O_7 \cdot 5H_2O$)
96.0% Water The panels were then rinsed off with water, dried and placed in a salt fog for 168 hours at 95° F. according to standard ASTM method B-117. The panels showed no noticeable pitting in the treated area.

Our examples show a substantial improvement over a potassium permanganate—sodium hydroxide composition and over the use of chromate compositions. Our compositions do not have the toxicity of the chromates and are therefore more environmentally effective.

The above procedures may be repeated at room temperature. However, the panel would then be immersed for approximately one hour instead of one minute.

I claim:

1. A basic pH aluminum coating composition to provide a a protective conversion coating for aluminum and aluminum alloys comprising as the essential ingredient thereof an alkali metal permanganate and a buffer compound selected from the group consisting of an alkali metal tetraborate, alkali metal metaborate, benzoic acid, alkali metal benzoate, alkali metal carbonate, and a mixture of the alkali metal tetra and metaborate.

2. The composition of claim 1 wherein the permanganate is potassium permanganate.

3. The composition of claim 2 wherein one of the essential ingredients is selected from the group consisting of sodium tetraborate, sodium metaborate and mixtures thereof.

4. The composition of claim 1 having a pH in the range of 7 to 12.5.

5. The base composition of claim 4 wherein the pH is in the range of 9 to 10.

6. The base oomposition of claim 4 wherein the composition contains as an essential ingredient a compound selected from the group consisting of alkali metal tetraborate, alkali metal metaborate, alkali metal benzoate, alkali metal carbonate, benzoic acid, and mixtures of the alkali metal tetra and metaborate.

7. The composition of claim 6 which contains potassium permanganate and sodium tetraborate.

8. The composition of claim 7 wherein the composition contains at least 500 mg/l of borax-$5H_2O$.

9. The composition of claim 4 wherein the composition contains at least 700 ppm of manganese and a buffer selected from the group consisting of benzoic acid, alkali metal tetraborate, alkali metal metaborate, mixtures of the alkali metal tetra and metaborates, alkali metal benzoate, and alkali metal carbonate.

10. The composition of claim 9 wherein the buffer is sodium benzoate.

11. The composition of claim 9 wherein the composition contains at least 500 mg/l of borax-$5H_2O$.

12. The composition of claim 1 which contains:

0.05 to 9% by weight borax-$5H_2O$
0.2 to 6.3% by weight of $KMnO_4$.

13. The composition of claim 1 wherein the composition contains:

0.05% to 44% by weight of alkaline metal benzoate
0.2 to 6.3% by weight of $KMnO_4$.

14. The composition of claim 1 wherein the composition contains:

0.05% to 31.5% by weight of sodium carbonate
0.2 to 6.3% by weight of $KMnO_4$.

15. The composition of claim 1 wherein all percentages are by weight and selected from the group consisting of those containing as essential ingredients:

(a) 1.0% borax-$5H_2O$, 0.2% $KMnO_4$;
(b) 0.05% borax-$5H_2O$, 3.0% $KMnO_4$;
(c) 9.0% borax-$5H_2O$, 4.0% $KMnO_4$;
(d) 1.0% borax-$5H_2O$, 1.0% $KMnO_4$;
(e) 1.0% sodium benzoate, 1.0% $KMnO_4$;
(f) 1.0% $Na_2CO_3$, 1.0% $KMnO_4$;
(g) 1.0% borax-$5H_2O$, 3.0% $KMnO_4$.

16. A method of protecting aluminum and aluminum alloys with a protective coating comprising contacting the aluminum with a base aqueous solution containing as essential ingredients an alkali metal permanganate and a buffer compound selected from the group consisting of alkali metal tetraborate, alkali metal metaborate, alkali metal carbonates, benzoic acid, alkali metal benzoate, and mixtures of alkali metal meta-and tetraborate, said solution having a pH in the range of 7 to less than 12.5, forming a conversion coating on the aluminum, and removing any excess coating solution from the aluminum.

17. The method of claim 16 wherein the pH of the solution is in the range of 9 to 10.

18. The method of claim 6 wherein the solution also contains as an essential ingredient a compound selected from the group consisting of alkali metal tetraborate, alkali metal metaborate, alkali metal carbonates, benzoic acid, alkali metal benzoate, and mixtures of alkali metal meta-and tetraborate.

19. The method of claim 17 wherein the solution contains at least 500 mg/l of borax-$5H_2O$ and 700 ppm of Manganese.

20. The method of claim 19 wherein the permanganate is potassium permanganate and the solution also contains sodium nitrate.

21. The method of claim 16 wherein the aluminum is first cleaned with a cleaning composition selected from sodium hydroxide, hydrofluoric acid and borax.

22. The method of claim 17 wherein the aluminum is first cleaned with a cleaning composition selected from sodium hydroxide, hydrofluoric acid and borax.

23. The method of claim 19 wherein the aluminum is first cleaned with a cleaning composition selected from sodium hydroxide, hydrofluoric acid and borax.

24. Aluminum and aluminum alloys having a corrosion resistant coating thereon produced by the method of claim 16 and being corrosion resistant to a salt fog for at least 168 hours.

25. Aluminum and aluminum alloys having a corrosion resistant coating thereon produced by the method of claim 14.

26. Aluminum and aluminum alloys having a corrosion resistant coating thereon produced by the method of claim 19 and being corrosion resistant to a salt fog for at least 168 hours.

27. Aluminum and aluminum alloys having a corrosion resistant coating thereon produced by the method of claim 20 and being corrosion resistant to a salt fog for at least 168 hours.

28. Aluminum and aluminum alloys having a corrosion resistant coating thereon produced by the method of claim 23 and being corrosion resistant to a salt fog for at least 168 hours.

29. Aluminum or aluminum alloy coated with a composition containing as the essential ingredient thereof an alkali metal permanganate and a buffer compound selected from the group consisting of an alkali metal tetraborate, alkali metal metaborate, benzoic acid, alkali metal benzoate, alkali metal carbonate, and a mixture of alkali metal tetra and metaborate.

30. The aluminum or aluminum alloys of claim 29 wherein said composition has a pH in the range of 7 to less than 12.5.

31. The aluminum or aluminum alloys of claim 30 coated with a composition wherein the composition contains as an essential ingredient a compound selected from the group consisting of alkali metal tetraborate, alkali metal metaborate, alkali metal benzoate, and mixtures of the alkali metal tetra-and metaborate.

32. The aluminum or aluminum alloys of claim 31 wherein the composition contains at least 700 ppm of Manganese and 500 mg/l of borax-$5H_2O$.

33. The aluminum or aluminum alloys of claim 30 coated with a composition containing:

0.05 to 9% by weight borax-$5H_2O$, and 0.2 to 6.3% by weight of $KMnO_4$.

34. The aluminum or aluminum alloys of claim 30 coated with a composition containing:

0.05% to 44% by weight of alkali metal benzoate and 0.2 to 6.3% by weight of $KMnO_4$.

35. The aluminum or aluminum alloys of claim 30 coated with a composition containing:

0.05% to 31.5% by weight of sodium carbonate and 0.2 to 6.3% by weight of $KMnO_4$.

36. The aluminum or aluminum alloys of claim 30 coated with a composition selected from the group consisting of those containing as essential ingredients:

(a) 1.0% borax-$5H_2O$, 0.2% $KMnO_4$;

(b) 0.05% borax-$5H_2O$, 3.0% $KMnO_4$;

(c) 9.0% borax-$5H_2O$, 4.0% $KMnO_4$;

(d) 1.0% borax-$5H_2O$, 1.0% $KMnO_4$;

(e) 1.0% sodium benzoate, 1.0% $KMnO_4$;

(f) 1.0% $Na_2CO_3$, 1.0% $KMnO_4$; and (g) 1.0% borax-$5H_2O$, 3.0% $KMnO_4$.

* * * * *